US008919776B2

(12) United States Patent
Bellone et al.

(10) Patent No.: US 8,919,776 B2
(45) Date of Patent: Dec. 30, 2014

(54) ARTICLE OF FOOTWEAR WITH MAZE

(75) Inventors: Linda Bellone, Wallkill, NY (US); Alison O'Brien, Norwell, MA (US)

(73) Assignee: BBC International LLC, Boca Raton, FL (US)

( * ) Notice: Subject to any disclaimer, the term of this patent is extended or adjusted under 35 U.S.C. 154(b) by 340 days.

(21) Appl. No.: 13/454,460

(22) Filed: Apr. 24, 2012

(65) Prior Publication Data

US 2013/0276334 A1 Oct. 24, 2013

(51) Int. Cl.
*A63F 9/08* (2006.01)

(52) U.S. Cl.
USPC ..... 273/153 R; 273/DIG. 18; 273/109; 273/113

(58) Field of Classification Search
USPC ..... 273/153 R, 109, 113, DIG. 18, 441, 444; 36/136
See application file for complete search history.

(56) References Cited

U.S. PATENT DOCUMENTS

| | | | | |
|---|---|---|---|---|
| 1,040,058 | A | 10/1912 | Tomlin | |
| D60,450 | S | 2/1922 | Escobar | |
| D132,197 | S | 4/1942 | Daniels | |
| D142,749 | S | 10/1945 | Tiemeyer et al. | |
| 2,722,063 | A | 11/1955 | Drefvelin | |
| 2,811,811 | A * | 11/1957 | Faranda | 273/DIG. 18 |
| 3,114,981 | A | 12/1963 | Murawski | |
| 3,188,087 | A | 6/1965 | Larson, Jr. | |
| D228,005 | S * | 7/1973 | Stubbmann | 273/153 R |
| 3,811,676 | A | 5/1974 | Greenberg | |
| 4,075,772 | A | 2/1978 | Scurella | |
| 4,281,467 | A | 8/1981 | Anderie | |
| 4,311,310 | A * | 1/1982 | Dankman et al. | 273/109 |
| 4,685,224 | A | 8/1987 | Anger | |
| D301,657 | S | 6/1989 | Brown | |
| D329,731 | S | 9/1992 | Adcock et al. | |
| 5,314,181 | A * | 5/1994 | Lin | 273/109 |
| 5,812,063 | A | 9/1998 | Weng et al. | |
| D400,347 | S | 11/1998 | Gaudio | |
| D404,194 | S | 1/1999 | Smith | |
| 5,894,201 | A | 4/1999 | Wong | |
| 5,969,479 | A | 10/1999 | Wong | |
| 6,012,822 | A | 1/2000 | Robinson | |
| 6,101,747 | A * | 8/2000 | Myles | 273/DIG. 18 |
| 6,220,917 | B1 | 4/2001 | Nelson | |
| 6,230,501 | B1 | 5/2001 | Bailey, Sr. et al. | |
| 6,286,975 | B1 | 9/2001 | Rodgers | |
| 6,383,098 | B1 * | 5/2002 | Haumschilt et al. | 273/DIG. 18 |
| 6,525,487 | B2 | 2/2003 | Wei | |
| D485,672 | S | 1/2004 | Holmes | |
| D485,673 | S | 1/2004 | Smith | |
| 6,688,935 | B1 * | 2/2004 | Lin | 273/153 R |
| 6,742,780 | B1 | 6/2004 | Rudski | |
| D498,580 | S | 11/2004 | Schambra | |
| D498,583 | S | 11/2004 | Yun | |

(Continued)

FOREIGN PATENT DOCUMENTS

| | | | |
|---|---|---|---|
| CN | 201324523 | Y | 10/2009 |
| FR | 2592802 | A1 | 7/1987 |

*Primary Examiner* — Steven Wong
(74) *Attorney, Agent, or Firm* — GrayRobinson, PA

(57) ABSTRACT

An article of footwear is provided having one or more maze units each comprising a base mounted to the upper of the footwear, a transparent cover secured about the periphery of the base defining a hollow enclosure and an array of partitions located within the enclosure forming channels along which one or more objects are movable.

19 Claims, 3 Drawing Sheets

(56) References Cited

U.S. PATENT DOCUMENTS

| | | | | |
|---|---|---|---|---|
| 6,865,825 | B2 | 3/2005 | Bailey, Sr. et al. | |
| D516,786 | S | 3/2006 | Besanceney, III | |
| 7,178,929 | B2 | 2/2007 | Guzman | |
| 7,254,910 | B2 | 8/2007 | Guzman | |
| 7,264,155 | B2 | 9/2007 | Halbur et al. | |
| 7,367,565 | B2 | 5/2008 | Chiu | |
| 7,540,097 | B2 | 6/2009 | Greene et al. | |
| D615,284 | S | 5/2010 | McDonald | |
| 7,774,884 | B2 | 8/2010 | Greene et al. | |
| 7,980,917 | B2 | 7/2011 | Guzman | |
| 2004/0237351 | A1* | 12/2004 | Howell | 36/136 |
| 2005/0016028 | A1 | 1/2005 | Safdeye | |
| 2005/0223601 | A1* | 10/2005 | Dabah | 36/136 |
| 2006/0283043 | A1 | 12/2006 | Lamstein | |
| 2012/0278999 | A1* | 11/2012 | James | 12/142 R |

* cited by examiner

ARTICLE OF FOOTWEAR WITH MAZE

FIELD OF THE INVENTION

This invention relates to articles of footwear, and, more particularly, to a shoe having one or more maze units each comprising a base mounted to the upper of the shoe, a transparent cover secured about the periphery of the base defining a hollow enclosure and an array of partitions located within the enclosure forming channels along which one or more objects are movable.

BACKGROUND OF THE INVENTION

For a number of years, articles of footwear and various items of clothing have been sold with decorative arrays of light sources such as light emitting diodes (LEDs) and/or a loudspeaker capable of producing a sound. This has been particularly popular in children's shoes where the LEDs are arranged to complement other design elements of the shoe such as cartoon characters and the like.

In a typical design of a children's shoe of the type noted above, a module is placed in a cavity usually formed in the heel area of the shoe. The module contains a battery and typically an integrated circuit which is connected by wires to LEDs positioned along the outsole or upper of the shoe. The integrated circuit may also be capable of generating a signal which operates a loudspeaker, typically mounted in the upper or tongue of the shoe in the general area of the LEDs. Systems of this type are shown, for example, in U.S. Pat. Nos. 6,525,487; 6,286,975; 6,012,822; 5,969,479; 5,894,201; 5,812,063 and others.

In addition to the use of LEDs and loudspeakers, efforts have been made to provide children's shoes that are more interesting and interactive for the wearer of the shoe. For example, U.S. Pat. No. 7,980,917 discloses a system in which sensors mounted to the outsole or upper of the shoe may be actuated to control the movement of a toy vehicle via RF signals transmitted from the shoe to a receiver in the vehicle. The shoe taught in U.S. Pat. No. 7,254,910 includes switches which are connected to an integrated circuit coupled to LEDs and/or a loudspeaker located on the upper or outsole of the shoe. In response to the application of a magnetic field from a permanent magnet located externally of the shoe, one or more of the switches are actuated, which, in turn, enables the integrated circuit to activate the LEDs or loudspeaker. U.S. Pat. No. 7,178,929 discloses a system wherein an RF transmitter housed in a band worn on the wrist of a child may be activated to send a signal to an RF receiver in the child's shoe. In response to receipt of the RF signal, an electrical circuit activates LEDs and/or loudspeakers in the shoe.

SUMMARY OF THE INVENTION

This invention is directed to an article of footwear having one or more maze units each comprising a base mounted to the upper of the footwear, a transparent cover secured about the periphery of the base defining a hollow enclosure and an array of partitions located within the enclosure forming channels along which one or more objects are movable.

In the presently preferred embodiment, each maze unit comprises a base and an array of partitions extending outwardly from the base in such a way as to form one or more channels. The base and partitions are preferably formed in a one-piece construction, such as by injection molding or other suitable process. A transparent cover, preferably formed of plastic, overlies the base and partitions forming a hollow enclosure. One or more objects, such as balls, are located in the enclosure and movable along the channels. The maze units may be mounted at essentially any location on the upper of the shoe, e.g. toe area, heel, sides, tongue etc., such as by gluing or stitching the base onto the upper.

Each maze unit may include one or more switches coupled to a module preferably located in the heel of the shoe. One or more integrated circuits or other controllers are coupled to the switch(es) and to LEDs and/or a loudspeaker arranged on the upper or outsole. In response to contact of a switch by one of the balls moving within the maze unit, the controller(s) is operative to cause the LEDs to illuminate and/or the loudspeaker to sound.

The shoe of this invention provides entertainment and an interactive challenge for a child. He or she may manipulate the foot while wearing the shoe in order to direct the ball(s) along the maze, or the child may remove the shoe and manipulate it by hand, all by tilting the shoe in a toe-to-heel direction, a side-to-side direction or combinations thereof. In either case, if the child can maneuver the ball(s) into contact with one of the switches in a maze unit, he or she is rewarded by illumination of the LEDs and/or sounding of the loudspeaker.

DESCRIPTION OF THE DRAWINGS

The structure, operation and advantages of the presently preferred embodiment of this invention will become further apparent upon consideration of the following description, taken in conjunction with the accompanying drawings, wherein.

DETAILED DESCRIPTION OF THE INVENTION

Figure 1:
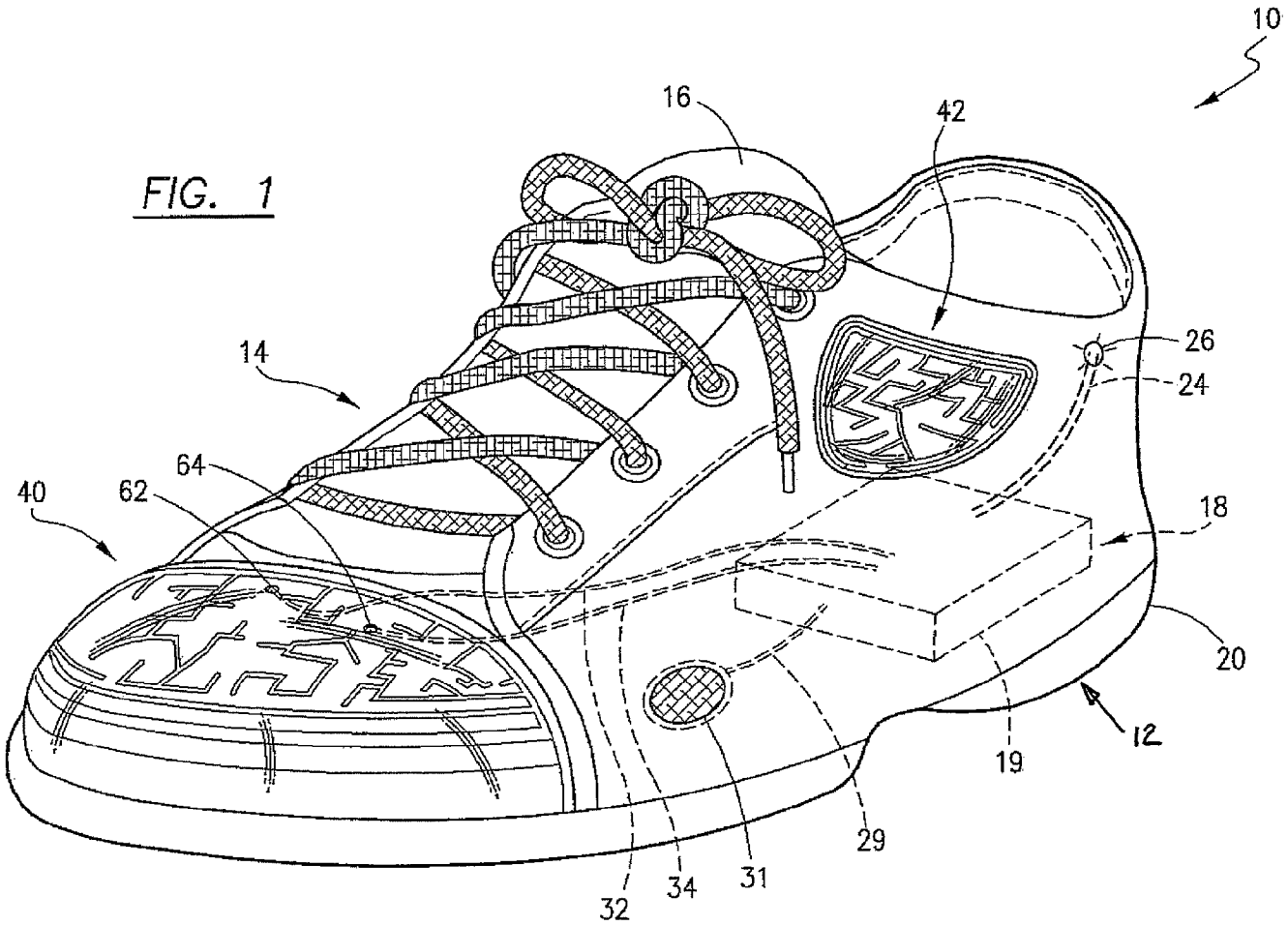
FIG. 1 is a perspective view of a shoe having a module and two exemplary maze units mounted to the upper of the shoe.

Referring now to the drawings, an article of footwear such as a shoe 10 is shown having an outsole 12 connected to an upper 14 including a tongue 16. It should be understood that any other article of footwear is considered within the scope of this invention, and the shoe 10 is shown for purposes of illustration. As such, the term "upper" is meant to broadly encompass essentially any shoe element mounted to the outsole of an article of footwear such as the straps of a sandal, etc.

Figure 5:
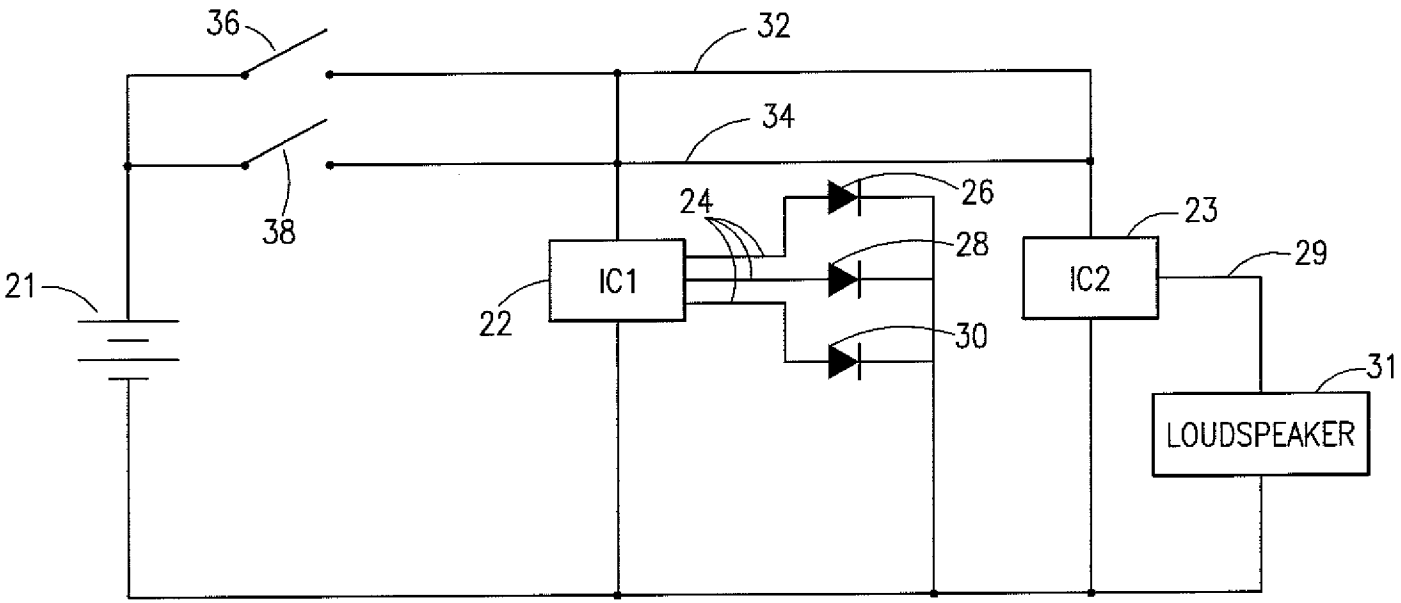
FIG. 5 is a schematic circuit diagram of one embodiment of the electrical circuit associated with the shoe of FIG. 1.

A module 18 having a housing 19 preferably made of plastic is mounted in the heel 20 of the shoe 10. The housing 19 encloses a battery 21 coupled to a first integrated circuit (IC1) 22 and to a second integrated circuit (IC2) 23. For purposes of the present discussion, the integrated circuits 22 and 23 may each be characterized as a "controller." See FIG. 5. A cavity (not shown) is hollowed out of the heel 20 to receive the module 18, over which the sock liner or insole of the shoe 10 is secured. As schematically illustrated in FIGS. 1 and 5, the first integrated circuit 22 may be connected by wires 24 to an array of LEDs 26, 28 and 30 mounted to the outsole 12 or upper 14 of the shoe 10, one of which is shown in FIG. 1. Essentially any number of LEDs may be arranged on the shoe 10, as desired. The second integrated circuit 23 may be connected by a wire 29 to a loudspeaker 31 located on the side of the upper 14 or another other position on the upper 14 including the tongue 16. The LEDs 26-30 and the loudspeaker 31 are individually and/or collectively referred to a "reward indicia" for purposes of the present discussion. Additionally, the module 18 may be connected by wires 32, 34 to respective switches 36 and 38 housed within a maze unit 40, as described in detail below.

As illustrated in FIG. 1 a maze unit 40 may be located in the toe area of the shoe 10, and a second maze unit 42 may be positioned along the side of the upper 14. It should be understood that the number and location of the maze units 40 and 42 shown in FIG. 1 is for purposes of illustration only. Additional maze units may be included on the shoe 10 and may be located at any other position on the upper 14, including the tongue 16, but preferably at a location which may be viewed when wearing the shoe 10. Further, only one maze unit 40 or 42 may be mounted to the shoe 10, as desired.

Figure 2:
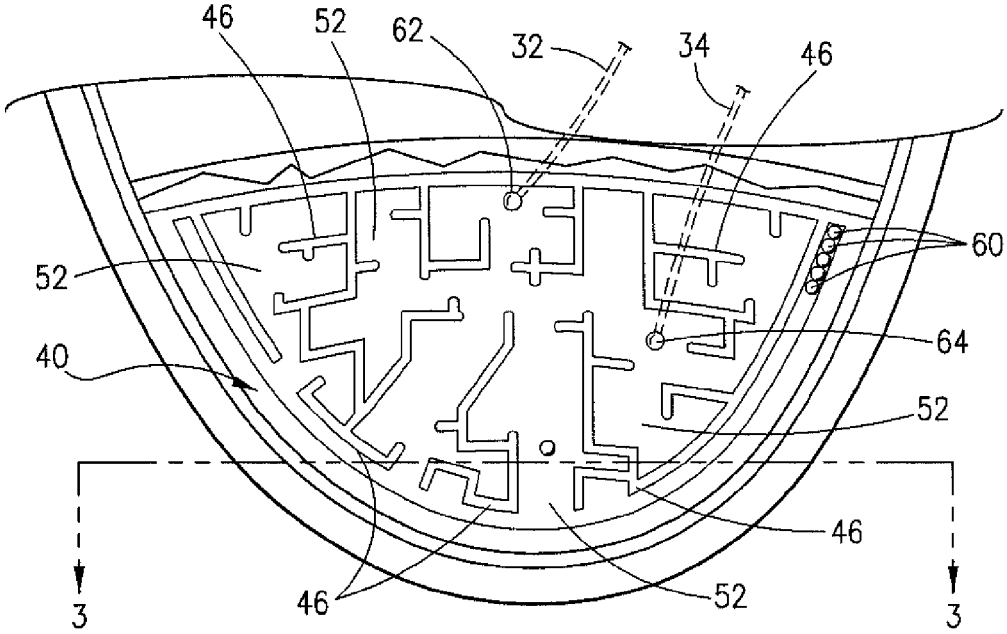
FIG. 2 is a partial plan view of the maze unit located in the toe area of the shoe.
Figure 3:
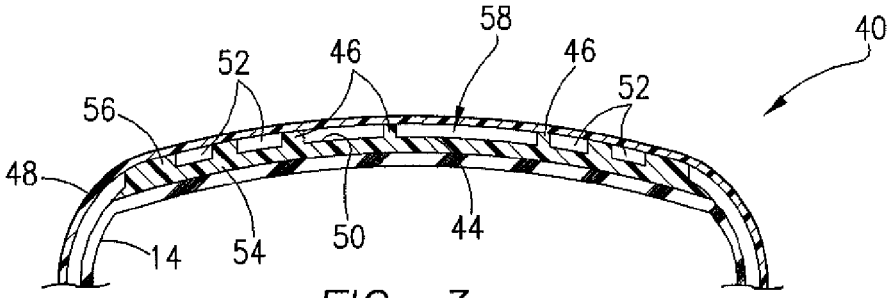
FIG. 3 is an enlarged, partial cross sectional view taken generally along line 3-3 of FIG. 2.

Referring now to FIGS. 2 and 3, in one presently preferred embodiment the maze unit 40 comprises a base 44, partitions 46 and a cover 48. The base 44 and partitions 46 are preferably formed in a one-piece construction, such as by an injection molding process or other suitable method of manufacture. The partitions 46 extend outwardly from a playing surface 50 of the base 44 and are arranged in an array or pattern such that one or more channels 52 are formed between adjacent partitions 46. The base 44 has a mounting surface 54 opposite the playing surface 50 which may be connected to the upper 14 of the shoe 10 by stitching, adhesive or any other suitable means. The cover 48 overlies the partitions 46 and channels 52 of the maze unit 40 and may be connected to the outermost edge of the partitions 46, and to an outer portion 56 of the base 44, to form an enclosure 58 defining a hollow, closed interior. The cover 48 is preferably formed of a transparent plastic or other suitable material. As schematically depicted in FIG. 3, the cover 48 may extend from the outer portion 56 of the base 44 generally parallel to the upper 14 for connection to the outsole 12 and/or to the upper 14. One or more objects, such as balls 60, may be located within the enclosure 58 and travel along the channel(s) 52 in response to movement of the shoe 10.

In one presently preferred embodiment, the base 44 may be formed with two recesses 62 and 64, each extending from the playing surface 50 in a direction toward the mounting surface 54. The switches 36 and 38 are mounted in respective recesses 62, 64 in position to engage one of the balls 60 which may enter a recess 62 or 64 while moving along the channels 52. Alternatively, the switches 36 and 38 may be positioned elsewhere within the enclosure 58, such as flush with the playing surface 50 within a channel 52, in one or more of the partitions 46 or at any other location where one of the balls 60 may make contact with them. Further, it should be understood that essentially any number of switches may be used in the maze unit 40 of this invention.

Figure 4:
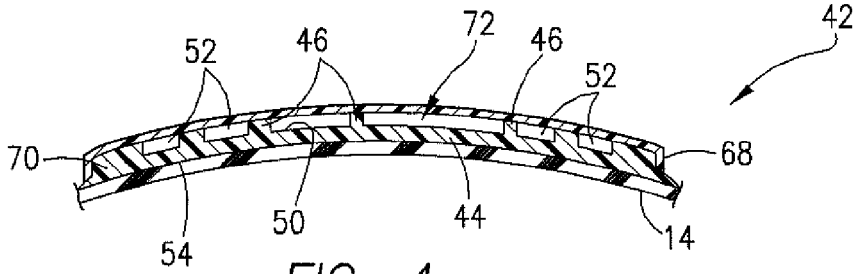
FIG. 4 is a view similar to FIG. 3 except of a maze unit located along the side of the upper as depicted in FIG. 1.

As best seen in FIGS. 1 and 4, the maze unit 42 is similar to maze unit 40 and the same reference numbers used above to describe maze unit 40 are employed to identify like structure in FIG. 4. The base 44, partitions 46 and channel(s) 52 of maze units 40 and 42 are the same, and the mounting surface 54 of the base 44 may be connected to the upper 14 in the same manner as described above. However, a cover 66 is employed in maze unit 42 having an outer rim portion 68 that connects to a peripheral edge 70 of the base 44. The cover 66 is transparent and formed of the same material as cover 48 of maze unit 40. Preferably, the cover 66 overlies the base 44 forming an enclosure 72 defining a hollow closed interior within which the partitions 46, playing surface 50 and balls 60 are enclosed. Although not shown in FIG. 1, the maze unit 42 may include any number of switches, such as the switches 36 and 38 described above in connection with a discussion of the maze unit 40, for connection by wires (not shown) to the module 18. The switches in maze unit 42 may be mounted in recesses formed in the base 44, or at other locations within the enclosure 72, as described above in connection with the maze unit 40.

A child may guide the balls 60 along the channels 52 of the maze units 40, 42 by moving his or her foot while wearing the shoe 10, or by removing the shoe 10 and manipulating it by hand, all by tilting the shoe 10 in a toe-to-heel direction, a side-to-side direction or combinations thereof. As depicted in FIG. 5, each of the switches 36 and 38 is connected to both the first integrated circuit 22 and the second integrated circuit 23. When a ball 60 engages one of the switches 36, 38 located in either of the maze units 40 or 42 one or both of the "reward indicia" are activated, i.e. the first integrated circuit 22 may operate to cause the LEDs 26-30 to illuminate, preferably in a flashing pattern, and/or the second integrated circuit 23 may operate to cause the loudspeaker 31 to sound. Illumination of the LEDs 26-30 and/or sounding of the loudspeaker 31 provide positive reinforcement and rewards the child for successfully "solving" the maze 40 and/or 42 as a result of moving one of the balls 60 to a desired location. In addition to enhancing motor skills of the child, the shoe 10 of this invention provides an interactive and fun experience.

While the invention has been described with reference to a preferred embodiment, it should be understood by those skilled in the art that various changes may be made and equivalents substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

We claim:

1. An article of footwear, comprising:

an upper connected to an outsole, said upper having a closure element which is operative to secure a user's foot to the article of footwear;

at least one maze unit located on said upper, said at least one maze unit comprising:

(i) a base permanently connected to said upper, at a location so as not to interfere with the installation and operation of said closure member;

(ii) an array of partitions extending outwardly from said base, said partitions being arranged in such a way as to form one or more channels;

(iii) a transparent cover overlying said base and forming an enclosure within which said partitions and said one or more channels are located;

(iv) at least one object located within said enclosure;

said at least one maze unit being tilted in response to movement of the user's foot so that said at least one object may be moved by the user to a desired location along said one or more channels.

2. The article of footwear of claim 1 in which said at least one maze unit is located in an area of the upper that may be viewed when wearing the footwear.

3. The article of footwear of claim 1 in which said base and said array of partitions are integrally formed in a one-piece construction.

4. The article of footwear of claim 1 in which said base is foamed with a peripheral edge, a playing surface and a mounting surface opposite said playing surface.

5. The article of footwear of claim 4 in which said transparent cover is formed with an outer rim portion, said outer rim portion being mounted to said peripheral edge of said base.

6. The article of footwear of claim 4 in which said mounting surface of said base is permanently affixed to said upper.

7. The article of footwear of claim 1 in which said transparent cover is mounted to one of said upper and said outsole.

8. The article of footwear of claim 1 in which said at least one object is one or more balls.

9. An article of footwear, comprising:

an upper connected to an outsole, said upper having a closure element which is operative to secure a user's foot to the article of footwear;

at least one maze unit located on said upper, said at least one maze unit comprising:

(i) a base permanently connected to said upper, at a location so as not to interfere with the installation and operation of said closure member;

(ii) an array of partitions extending outwardly from said base, said partitions being arranged in such a way as to form one or more channels;

(iii) a transparent cover overlying said base and forming an enclosure within which said partition and said one or more channels are located;

(iv) at least one switch located within said enclosure;

(v) at least one object located within said enclosure;

said at least one maze unit being tilted in response to movement of the user's foot so that said at least one object may be moved by the user into engagement with said at least one switch;

at least one controller coupled to said at least one switch and to one or more reward indicia mounted to said upper or to said outsole, said at least one controller being effective in response to engagement of said switch by said at least one object to activate said one or more reward indicia.

10. The article of footwear of claim 9 in which said base of said maze unit is formed with one or more recesses, said at least one switch comprising a switch located within each of said recesses, said at least one object being movable into each of said recesses to actuate said switch therein.

11. The article of footwear of claim 9 in which said at least one controller includes a first controller and said one or more reward indicia is a light source mounted to one of said upper and said outsole, said first controller being operative to illuminate said light source in response to engagement of said switch by said at least one object.

12. The article of footwear of claim 11 in which said at least one controller includes a second controller and said one or more reward indicia is a loudspeaker mounted to one of said upper and said outsole, said second controller being operative to sound said loudspeaker in response to engagement of said switch by said at least one object.

13. The article of footwear of claim 9 in which said base and said array of partitions are integrally formed in a one-piece construction.

14. The article of footwear of claim 9 in which said base is formed with a peripheral edge, a playing surface and a mounting surface opposite said playing surface.

15. The article of footwear of claim 14 in which said transparent cover is formed with an outer rim portion, said outer rim portion being mounted to said peripheral edge of said base.

16. The article of footwear of claim 14 in which said mounting surface of said base is permanently affixed to said upper.

17. The article of footwear of claim 9 in which said transparent cover is mounted to one of said upper and said outsole.

18. The article of footwear of claim 9 in which said at least one object is one or more balls.

19. The article of footwear of claim 9 in which said at least one maze unit is located in an area of the upper that may be viewed when wearing the footwear.

* * * * *